US005289241A

United States Patent [19]

Sugiyama et al.

[11] Patent Number: 5,289,241

[45] Date of Patent: Feb. 22, 1994

[54] DEVELOPING UNIT FOR AN IMAGE FORMING APPARATUS HAVING ADJOINING FRESH AND WASTE TONER CONTAINERS

[75] Inventors: Toshihiro Sugiyama, Yokohama; Toshihiko Takaya, Tokyo, both of Japan

[73] Assignee: Ricoh Company, Ltd., Tokyo, Japan

[21] Appl. No.: 822,978

[22] Filed: Jan. 21, 1992

[30] Foreign Application Priority Data

Jan. 21, 1991 [JP] Japan ..... 3-005291

[51] Int. Cl.[5] ..... G03G 15/06

[52] U.S. Cl. ..... 355/260; 355/205; 355/298

[58] Field of Search ..... 355/298, 260, 245, 205, 355/207, 203; 222/DIG. 1

[56] References Cited

U.S. PATENT DOCUMENTS

| | | | |
|---|---|---|---|
| 4,750,015 | 6/1988 | Ogura et al. | 355/203 |
| 4,768,055 | 8/1988 | Takamatsu et al. | 355/298 |
| 4,982,230 | 1/1991 | Ogura et al. | 355/298 |
| 4,982,231 | 1/1991 | Matsuuchi | 355/298 X |
| 5,237,373 | 8/1993 | Aimoto et al. | 355/298 |

FOREIGN PATENT DOCUMENTS

| | | | |
|---|---|---|---|
| 59-148080 | 8/1984 | Japan | 355/298 |
| 60-41079 | 3/1985 | Japan | 355/298 |

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

A developing unit incorporated in an image forming apparatus and having a waste toner container for collecting a waste toner and a fresh toner container containing a fresh toner and adjoining the waste toner container. When the waste toner container is filled with the waste toner, the developing unit causes the waste toner to enter the fresh toner container while preventing the fresh toner from entering the waste toner container. A wall separates the waste toner and fresh toner containers from each other and is formed with an opening. A shutter is associated with the opening and opens when the pressure inside the waste toner container increases due to the waste toner. The waste toner which enters the fresh toner container via the opening is agitated together with the fresh toner as far as possible and then fed to a developing roller or is collected in a container whose volume is variable.

8 Claims, 3 Drawing Sheets

DEVELOPING UNIT FOR AN IMAGE FORMING APPARATUS HAVING ADJOINING FRESH AND WASTE TONER CONTAINERS

BACKGROUND OF THE INVENTION

The present invention relates to a developing unit incorporated in an image forming apparatus and having a fresh toner container and a waste toner container which adjoin each other.

It is a common practice with a copier, facsimile transceiver, laser printer or similar image forming apparatus to electrostatically form a latent image on a photoconductive element by an electrophotographic process, develop the latent image to produce a toner image by a developing unit, and then transfer the toner image to a recording medium. The toner remaining on the photoconductive element after the image transfer is removed by a cleaning device.

The developing unit may be provided with a waste toner container and a fresh toner container adjoining each other with the intermediary of a wall, as disclosed in, for example, Japanese Patent Laid-Open Publication No. 74033/1974. In this type of developing device, the toner removed from the photoconductive element, i.e., waste toner is collected in the waste toner container, while a fresh toner to be fed to the developing unit is stored in the fresh toner container. As soon as the fresh toner container runs out of the fresh toner, it is removed from the unit together with the waste toner container and discarded. To enhance the efficient use of toner and the life of the unit, the waste toner collected in the waste toner container is again fed to a toner hopper to be reused for development.

However, reusing the waste toner is not desirable from the developing characteristic standpoint since it has a different developing characteristic from the fresh toner, i.e., it is usually constituted by the toner left in the image area and background of the photoconductive element without being transferred to a recording medium. This part of the toner carries an opposite charge or an unstable charge thereon. In light of this, the entire amount of waste toner may be collected in the waste toner container adjoining the fresh toner container. This, however, has a problem that the amount of waste toner to be produced depends on the ambient conditions and the kind of documents and, is, therefore, almost impossible to estimate beforehand. While the waste toner container may be provided with a sufficient volume, i.e., a volume which would accommodate the entire fresh toner, such a waste toner container is impractical since the space available in the developing unit is limited. In practice, therefore, the amount of waste toner to be produced is estimated by multiplying the amount of fresh toner by an experiential ratio and adding some margin to the product. As a result, when the actual ambient conditions are different from estimated ones, it is likely that the waste toner fills up the waste toner container and, in the worst case, flows out of such a container to smear the interior of the apparatus.

SUMMARY OF THE INVENTION

It is, therefore, an object of the present invention to provide a developing unit for an image forming apparatus which prevents, even when the amount of waste toner exceeds the volume of a waste toner container which adjoins a fresh toner container, the waste toner from leaking from the container by breaking it, without the container being increased in size more than necessary.

A developing unit incorporated in an image forming apparatus for developing a latent image electrostatically formed on a photoconductive element by a toner of the present invention comprises a fresh toner container containing a fresh toner, a waste toner container adjoining the fresh toner container for collecting a waste toner removed from the photoconductive element, a wall separating the fresh toner container and waste toner container and formed with an opening in part thereof for providing communication between the fresh toner container and the waste toner container, and a shutter associated with the opening for allowing the waste toner from being transferred from the waste toner container to the fresh toner container via the opening while preventing the fresh toner from being transferred from the fresh toner container to the waste toner container.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
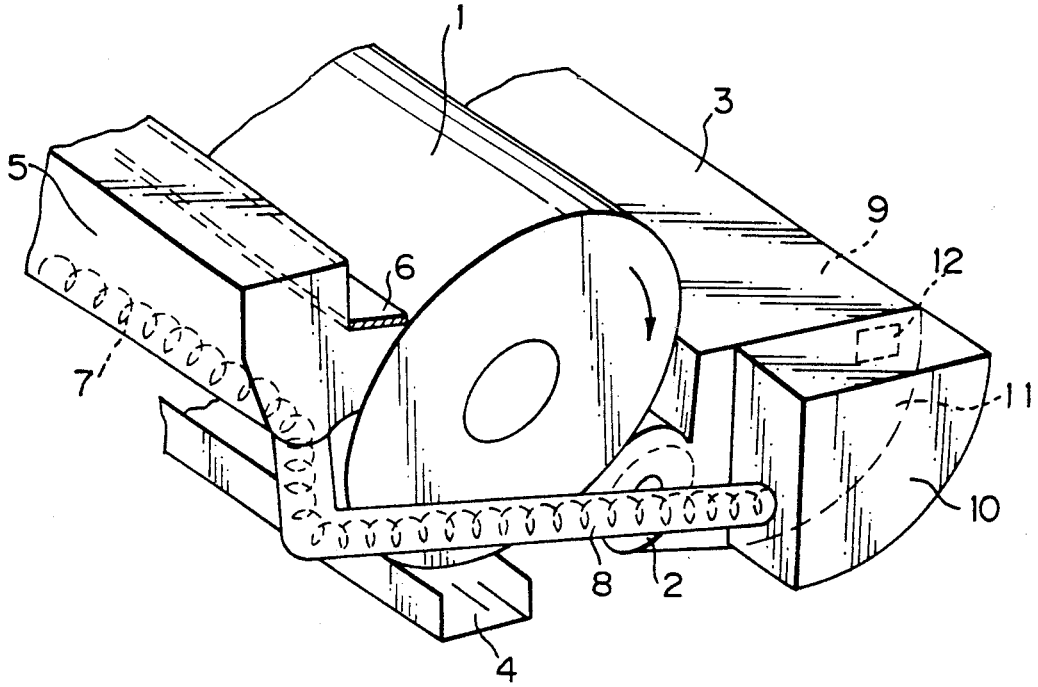
FIG. 1 is a perspective view showing a developing unit embodying the present invention together with a photoconductive element and a cleaning unit.

Referring to FIG. 1 of the drawings, a developing unit embodying the present invention is shown together with a photoconductive element and a cleaning unit. As shown, the developing unit, generally 3, has a developing roller 2 contacting the surface of the photoconductive element, or drum, 1. A toner is deposited on the developing roller 2 to develop a latent image electrostatically formed on the drum 1 by exposure. The resulting toner image is transferred to a recording medium or paper sheet, not shown, by a transfer charger 4. The toner remaining on the drum 1 after the image transfer is removed by a cleaning blade 6 included in the cleaning unit 5. A screw conveyor, coil wire or similar transporting means 7 conveys the toner removed by the cleaning blade 6 and dropped onto the bottom of the cleaning unit 5, i.e., waste toner toward one axial end thereof. A toner collecting tube 8 has, for example, a coil wire therein and extends in the lateral direction, as illustrated. The waste toner which reaches one end of the conveying means 7 is further driven via the collecting tube 8 to a waste toner container 10 which adjoins a fresh or new toner container 9 with the intermediary of a wall 11.

Figure 2:
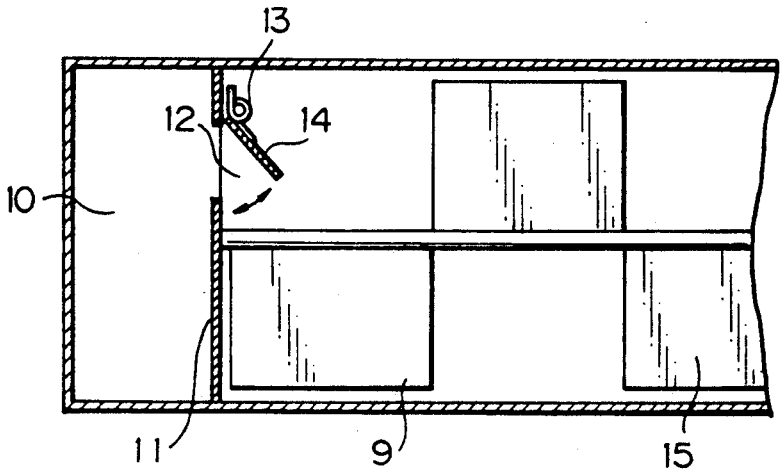
FIG. 2 is a fragmentary section of the developing unit shown in FIG. 1.

An opening 12 is formed through the wall 11 at a position remotest from the developing roller 2. As shown in FIG. 2, a shutter 14 is associated with the opening 12 and constantly biased by a spring 13 in a direction for closing the opening 12. The shutter 14 is movable, or openable, only toward the new toner container 9 as the pressure inside the waste toner container 10 increases. An agitator 15 is accommodated in the fresh toner container 9. In this configuration, as the waste toner is introduced into the waste toner container 10 despite that the latter has been filled with such a toner, the pressure inside the container 10 increases to urge the shutter 14 against the force of the spring 13. As a result, the waste toner is transferred from the waste toner container 10 to the fresh toner container 9. However, the fresh toner in the fresh toner container 9 is prevented from entering the waste toner container 10 since the shutter 14 will be closed by the spring 13. This is successful in preventing the fresh toner from being discarded before it is used and preventing the waste toner from being scattered around to smear the interior of the image forming apparatus. Since the waste toner transferred to the fresh toner container 9 is agitated together with the new toner by the agitator 15 and then supplied to the developing roller 2, the ratio of the waste toner to the entire toner is so small and does not effect the developing characteristic. In addition, the opening 12 is located as remote from the developing roller 2 as possible, allowing the waste toner to be sufficiently mixed with the fresh toner before it reaches the developing roller 2.

If desired, the shutter 14 for closing the opening 12 may be replaced with a thin paper sheet or similar material which breaks when subjected to the pressure of waste toner.

Figure 3A:
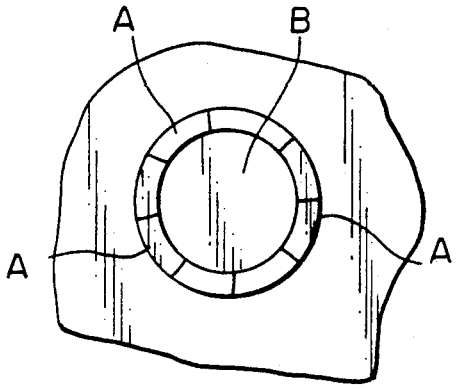
FIG. 3A is a front view of the embodiment.
Figure 3B:
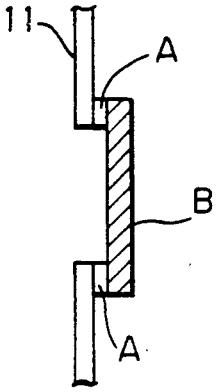
FIG. 3B is a section associated with FIG. 3A.

An arrangement may be made such that when the fresh toner container 9 is filled with a great amount of waste toner and the fresh toner, the operation of the image forming apparatus is interrupted. Such an arrangement should be provided with a sensor responsive to the full state of the fresh toner container. FIGS. 3A and 3B show a specific construction of the sensor. In FIGS. 3A and 3B, a shutter B is affixed to the wall 11 via a seal A which is divided into a plurality of sections, and a current is constantly fed between the sections of the seal A and the shutter B. Then, when a clearance is developed between any section of the seal A and the shutter B, the current stops flowing between the seal A and the shutter B, indicating that the fresh toner container 9 is full.

Figure 4:
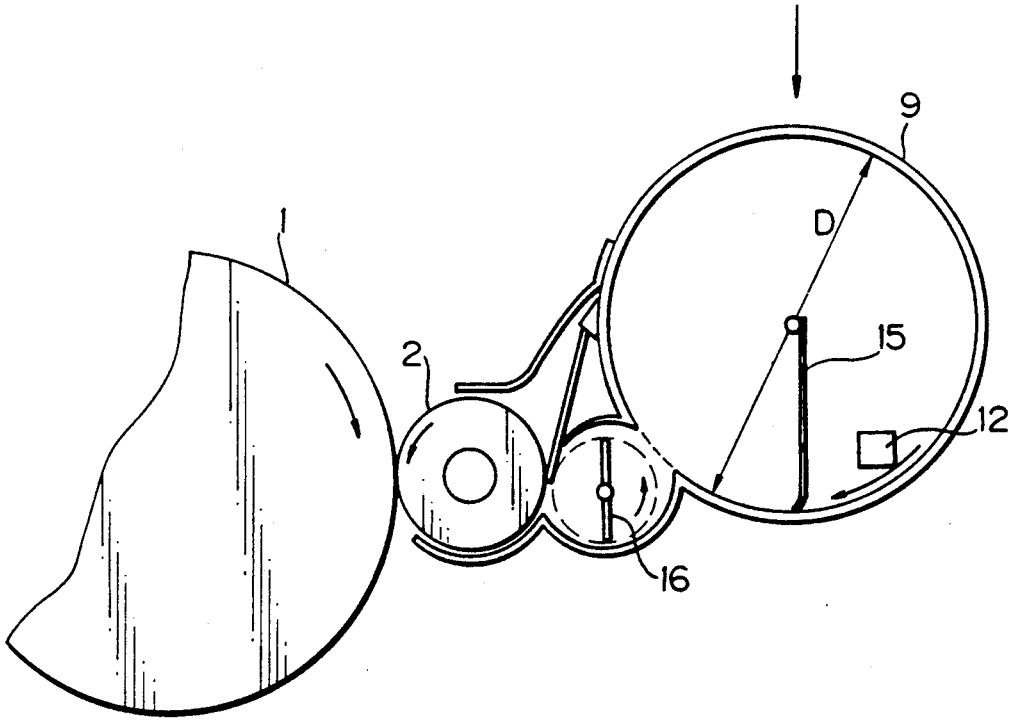
FIG. 4 is a section showing an alternative embodiment of the present invention.

FIG. 4 shows an alternative embodiment of the present invention which allows only a relatively small amount of waste toner to be mixed with the fresh toner, so that the waste toner which enters the fresh toner container 9 may not influence the developing characteristic. As shown, the fresh toner container 9 is implemented as a hollow cylinder having a diameter D. If the rotation speed N of the agitator 15 is adequately selected, the mixture ratio of the waste toner which enters the fresh toner container 9 will be improved. Experiments showed that the mixture ratio is acceptably high when N lies in the range of $24/\sqrt{D}$ to $40/\sqrt{D}$ and is optimal when N is $32/\sqrt{D}$. In the figures, the reference numeral 16 designates a toner supply member for supplying the toner from the fresh toner container 9 to the developing roller 2.

Figure 5:
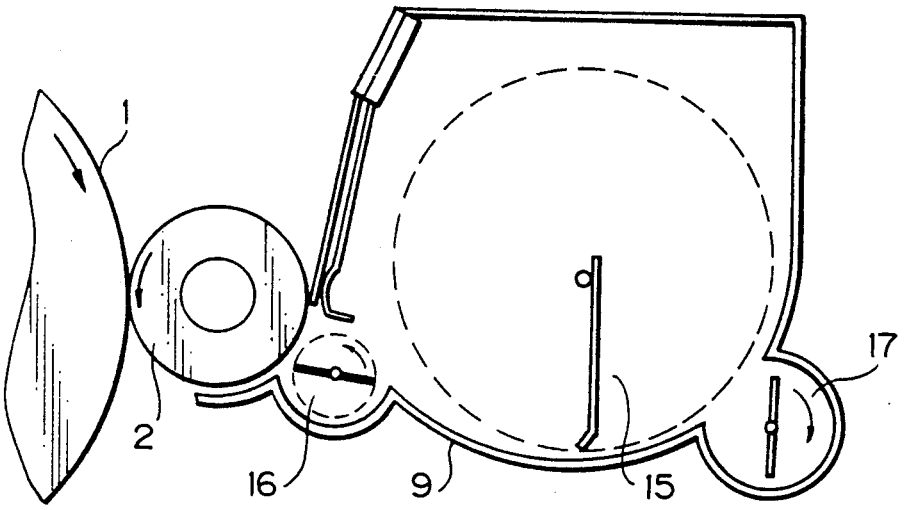
FIG. 5 is a section showing another alternative embodiment of the present invention.

As shown in FIG. 5, a section 17 for agitating the fresh and waste toner may provided in the fresh toner container 9 or in the vicinity thereof. This arrangement is also successful in achieving the above-stated result.

Figure 6:
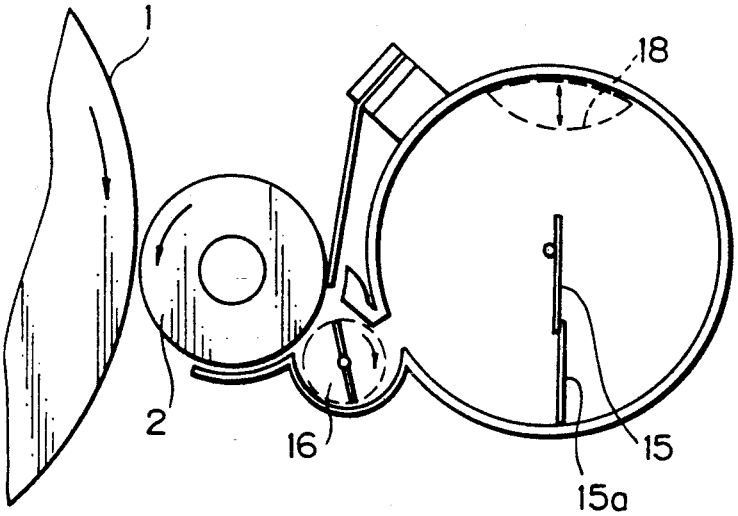
FIG. 6 is a section showing still another alternative embodiment of the present invention.

Further, as shown in FIG. 6, a waste toner container 18 having a variable volume may be defined by a flexible film. Specifically, as the fresh toner is sequentially fed out from the toner container 9 by the agitator 15, the flexible film forms the waste toner container 18 in the resulting cavity of the container 9. Then, the waste toner will be collected in such a container 18 and, therefore, prevented from being mixed with the fresh toner. In addition, such a configuration reduces the required volume of the waste toner container 18. It is noteworthy that the agitator 15 is provided with a Mylar sheet or similar elastic thin member over a certain range 15*a* thereof adjacent to the tip. The end portion 15*a* of the agitator 15, therefore, yields on contacting the variable-volume waste toner container 18 to protect the container 18 from breakage and to prevent the agitator 15 from sticking.

In summary, it will be seen that the present invention provides a developing unit which prevents a waste toner container adjoining a fresh toner container from being broken to contaminate the interior of an image forming apparatus. This is because, a shutter allows a toner to move only from the waste toner container to the fresh toner container via an opening formed through a wall which separates the two containers. As soon as the pressure inside the waste toner container increases due to the waste toner, the shutter opens automatically to transfer the waste toner to the fresh toner container. Since the fresh toner in the fresh toner container is prevented from entering the waste toner container, it is prevented from being discarded together with the waste toner before it is used.

Means for mixing the waste toner entered the fresh toner container with the fresh toner is provided between the above-mentioned opening and a developing roller. Such means reduces the mixture ratio of the waste toner to the entire toner to thereby prevent the developing ability from falling. To further insure the mixture of fresh and waste toners, the opening is located as remote from the developing roller as possible.

Moreover, a variable-volume waste toner container is defined by the cavity of the fresh toner container which was originally occupied by the fresh toner. Such a waste toner container collects the waste toner while preventing it from being mixed with the fresh toner.

Various modifications will become possible for those skilled in the art after receiving the teachings of the present disclosure without departing from the scope thereof.

What is claimed is:

1. A developing unit incorporated in an image forming apparatus for developing a latent image electrostatically formed on a photoconductive element by a toner, comprising:

a fresh toner container containing a fresh toner;

a waste toner container adjoining said fresh toner container for collecting a waste toner removed from said photoconductive element;

a wall separating said fresh toner container and said waste toner container and formed with an opening in part thereof for providing communication between said fresh toner container and said waste toner container; and shutter means associated with said opening for permitting the waste toner collected in the waste toner container to be transferred from said waste toner container to said fresh toner container via said opening when a predetermined amount of waste toner is collected in said waste toner container, while preventing said fresh toner contained in the fresh toner container from being transferred from said fresh toner container to said waste toner container.

2. A developing unit as claimed in claim 1, wherein said predetermined amount of waste toner in said waste toner container creates a pressure which is applied against said shutter means to uncover said opening and thereby communicate said fresh toner container and said waste toner container.

3. A developing unit as claimed in claim 2, further comprising a developing roller contacting said photoconductive element for carrying a toner on a surface thereof.

4. A developing unit as claimed in claim 3, further comprising toner mixing means interposed between said opening and said developing roller for mixing said waste toner which enters said fresh toner container via said opening with said fresh toner.

5. A developing unit as claimed in claim 3, wherein said opening is located as remote from said developing roller as possible.

6. A developing unit as claimed in claim 1, further comprising a waste toner container provided in said fresh toner container for collecting said waste toner which enters said fresh toner container while preventing said waste toner from being mixed with said fresh toner.

7. A developing unit as claimed in claim 1, further comprising sensor means for sensing a state in which said fresh toner container is full of waste toner and fresh toner so as to interrupt an operation of said image forming apparatus.

8. A developing unit as claimed in claim 7, wherein said sensor means detects a transfer of waste toner from said waste toner container to said fresh toner container by detecting an opening of said shutter means so as to interrupt said operation of said image forming apparatus and permit the replacement of the fresh toner container.

* * * * *